United States Patent [19]

Mynatt, Jr.

[11] Patent Number: 4,787,635

[45] Date of Patent: Nov. 29, 1988

[54] BALL AND HOOP GAME

[76] Inventor: Allen G. Mynatt, Jr., 308 Clevend Ave., Lehigh Acres, Fla. 33936

[21] Appl. No.: 55,834

[22] Filed: Jun. 1, 1987

[51] Int. Cl.[4] ..... A63B 67/14; A63H 33/08; A63H 5/00

[52] U.S. Cl. ..... 273/109; 446/170; 446/207; 446/219; 446/418

[58] Field of Search ..... 446/170, 207, 219, 236, 446/409, 417, 418, 421, 422, 431; 273/109

[56] References Cited

U.S. PATENT DOCUMENTS

| | | | |
|---|---|---|---|
| 457,259 | 8/1891 | Decoeur | 446/207 |
| 625,680 | 5/1899 | Jack | 273/109 |
| 2,198,075 | 3/1937 | Borek | 273/109 |
| 2,644,270 | 7/1953 | Marong | 446/170 |
| 3,060,627 | 10/1962 | Seretny | 446/170 |
| 4,479,649 | 10/1984 | Newcomb et al. | 273/58 G X |
| 4,496,154 | 1/1985 | Shazeer | 273/109 |
| 4,674,987 | 6/1987 | Sober | 446/170 X |

FOREIGN PATENT DOCUMENTS

| | | | |
|---|---|---|---|
| 213289 | 2/1961 | Australia | 273/109 |
| 528079 | 7/1956 | Canada | 446/418 |
| 655304 | 1/1963 | Canada | 273/109 |
| 2405770 | 8/1975 | Fed. Rep. of Germany | 273/109 |
| 1099684 | 9/1955 | France | 273/109 |
| 252374 | 10/1948 | Switzerland | 273/109 |

*Primary Examiner*—Robert A. Hafer
*Assistant Examiner*—Charles H. Harris
*Attorney, Agent, or Firm*—Richard C. Litman

[57] ABSTRACT

An eye-hand coordination game includes a hand-held hoop assembly and an untethered ball. A plurality of connecting posts and clicking assemblies join two rings of the hoop assembly. The game is utilized by keeping the unconstrained ball in motion along the inner edges of the rings via centrifugal force, whereupon a rhythmic, clicking sound is produced in time with the movement of the ball.

7 Claims, 2 Drawing Sheets

BALL AND HOOP GAME

BACKGROUND OF INVENTION

1. Field of Invention

This invention relates to games in general, and, more specifically, solitaire eye-hand coordination games of the ball and hoop variety. In particular, the game is an improvement of hoop games, employing a plurality of planar rings, connecting posts, clicking assemblies, and an unconstrained ball. By moving the hoop in a circular manner, the ball may be caused to roll around the inside edge of the rings via centrifugal force. This in turn causes a plurality of clicking assemblies to make a rhythmic sound in time with the movement of the ball. A number of strategies and games for improving eye-hand and body coordination can be designed with this device.

2. Description of the Prior Art

There are various prior art game devices and hoop games in particular. Their apparatuses and the method of their construction in general are known and are found to be exemplary of the U.S. prior art. They are:

| U.S. Pat. No. | Inventor |
|---|---|
| 146,787 | G. Stone |
| 185,257 | H. Post |
| 708,143 | E. Hinman |
| 1,535,144 | L. Aptowicz |

The patent to Stone (U.S. Pat. No. 146,787), discloses a toy comprising a hoop, radially spaced stay wires, center plates, and bells.

The patent to Post (U.S. Pat. No. 185,257), discloses a similar toy comprising a hoop, a diametrical rod and centrally placed, pivoting bell.

The patent to Hinman (U.S. Pat. No. 708,143), discloses a rolling toy comprising a hoop and enclosed pockets containing balls or similar objects.

The patent to Aptowicz (U.S. Pat. No. 1,535,144), discloses a hoop toy in which balls are placed in a tubular enclosure and made to strike bells upon rolling the hoop.

These patents or known prior uses teach and disclose various type of hoop games and similar devices, but none of them, whether taken singly or in combination, disclose the specific details of the invention in such a way as to bear upon the claims of the present invention.

SUMMARY OF THE INVENTION

An object, advantage and feature of the invention is to provide a novel hoop game comprising a wheel and an unconstrained ball.

It is another object and feature of the present invention to provide a hoop game that also produces a rhythmic sound while in operation.

It is still another object and advantage to provide a novel method for improving eye-hand and body coordination through the use of the invention.

It is still another object and advantage to provided a novel method for improving body coordination individually or together with others through the use of the invention.

It is yet another object and advantage of the invention to provide an auditory means for monitoring the progress of the unconstrained ball. There is a direct correlation between the speed of the ball and the rapidity of the rhythmic sound.

Furthermore, it is another object of the present invention to provide the user with a lighted ball or a ball that glows in the dark to improve visibility while in motion.

These, together with other objects and advantages of the invention reside in the details of the process and the operation thereof, as is more fully hereinafter described and claimed.

DESCRIPTION OF THE PREFERRED EMBODIMENT OF THE INVENTION

Figure 1:
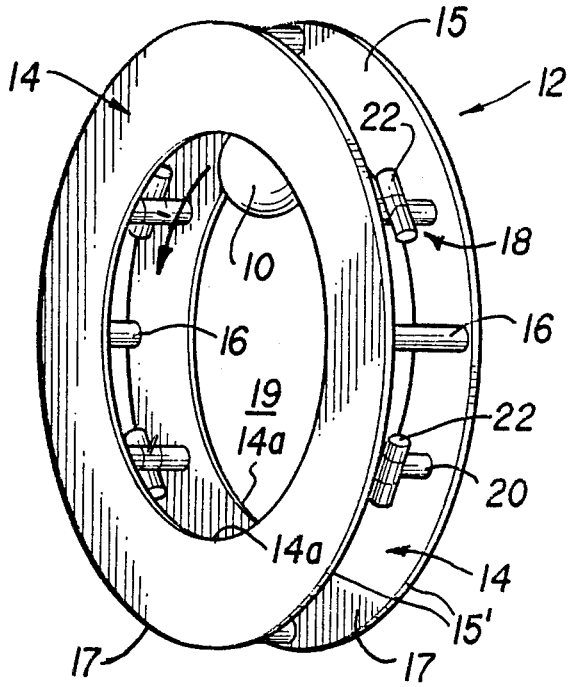
FIG. 1 depicts a perspective view of the invention.

The invention comprises a hoop assembly 12 adapted to cooperate with an unconstrained ball 10. The hoop assembly 12 includes a pair of identical planar rings 14—14, which may be constructed of any suitable material such as wood, plastics or composite material. A typical diameter for the rings may range between 16–20 inches. The two rings 14 are joined together in the axially spaced manner by a plurality of cylindrical connecting posts 16, to define a clearance 15 therebetween. Two diametrically opposed ones of these posts will be seen from FIG. 3 to provide handles by which the hoop assembly is manipulated, as will be described hereinafter. Disposed intermediate the posts 16 are a plurality of clicking assemblies 18, described in detail below. The unconstrained ball 10 preferably has a diameter slightly greater than the clearance 15 between the two planar rings 14—14 and is constructed of hollow plastic, soft rubber, or similar lightweight and pliable substance. In addition, the ball may be either lighted or made of a fluorescent or glow-in-the dark material to improve visibility while in motion. The diameter of the tall 10 is no less than the axial extent of the space 15 between the rings 14 such that the ball 10 may be supported by the inner periphery 14*a* of the two rings 14—14 when inserted within the opening 19.

Figure 2A:
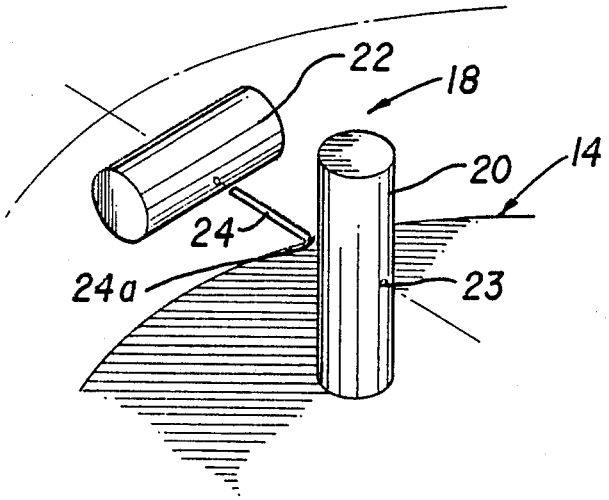
FIG. 2A depicts an exploded view of a click assembly, showing the relationship of the pieces.
Figure 2B:
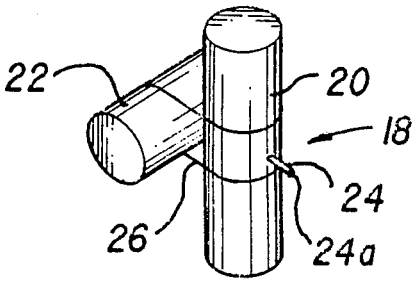
FIG. 2B depicts a perspective view of the click assembly, showing the placement of the elastic band.

As shown in FIGS. 2A and 2B, each clicking assembly 18 comprises a cylindrical stationary post 20, similar to the connecting posts 16 but including a clicking dowel 22 joined to the post 20 by a cylindrical pin 24 slidably disposed through the post. The clicker components are retained in the assembled arrangement of FIG. 2*b* by an elastic band 26 or other appropriate yieldable member.

The cylindrical connecting posts 16 are fastened by means such as nails or glue between the two planar rings 14 as shown in FIG. 1. These connecting posts 16 are located at least adjacent the corners of a square inscribed in the circle defined by the outer edge 15' of the rings.

The plurality of clicking assemblies 18 are located at points on the rings 14 equidistant and between the connecting posts 16 and preferably equidistant between the inner faces 17 of the rings. The stationary posts 20 are affixed to the rings 14 in a manner similar to the affixing of the connecting posts 16 and each includes a radially extending hole 23 disposed through the center of the post 20. With the stationary posts 20 positioned so that the holes 23 are aligned radially with respect to the rings 14, each of the sliding pins 24 will be attached perpendicularly to the center of the clicking dowel 22. When the sliding pin 24, with the dowel 22 fastened perpendicularly thereto, is inserted into the hole 23 in the stationary post 20 the free inner end 24*a* of the pins will be disposed near the plane joining the ring inner peripheries 14*a*. The dowels 22 are affixed to the stationary posts 20 by wrapping an elastic band 26 in a saddle-shaped configuration as shown in FIG. 26.

Figure 3:
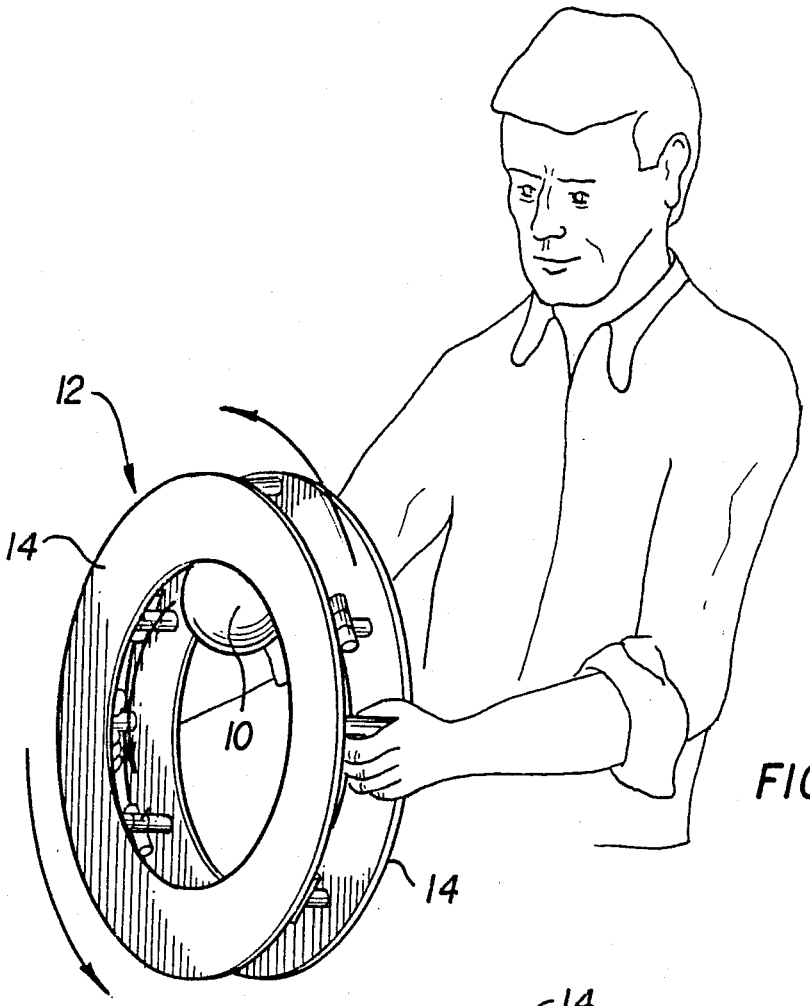
FIG. 3 displays the invention in use.

In FIG. 3 the invention is shown in use. The ball 10 is placed between the rings 14, along their inner peripheries 14*a*. The wheel 12 is then grasped, by two opposed posts 16—16 and moved in a circular or elliptical manner so that the ball 10 is kept in motion around the inner edges 14*a*. When the ball 10 comes in contact with the sliding pins 24, its motion pushes the pins 24 outward, which in turn pushes the clicking dowels 22 outward. Then, when the ball 10 moves away from the sliding pins 24, the elastic bands 26 draw the pins 24 and clicking dowels 22 back to their original position with sufficient force to produce an audible tone. Thus, as the ball 10 moves around the inner edges 14*a* at a constant velocity, the wheel 12 produces a rhythmic series of clicking tones.

Figure 4:
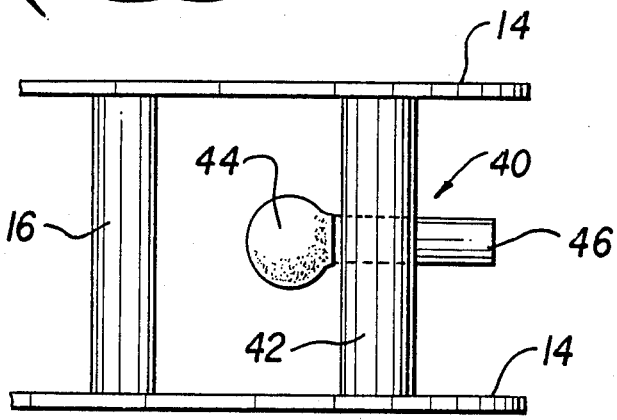
FIG. 4 shows another embodiment of the invention with a bulb-and-reed sound assembly.

FIG. 4 shows another embodiment of the invention in which the clicking assembly of FIG. 26 is replaced with a bulb-and-reed sound device 40. This device comprises a supporting post 42 to which is attached a reed 46 having an end mounted sounding bulb 44. Sounding bulb 44 is disposed in the center of the supporting post 42 and extends toward the center of the wheel as in the case of the pin ends 24*a*. The sounding bulbs 44 pass through a gap in the supporting posts 42 and connect to the reed 46 so that when the unconstrained ball 10 makes contact with the sounding bulb 44 the air in the bulb is compressed, causing reed 46 to produce a sound in time with the movement of the ball. Other forms of oscillators or buzzers can be used in place of the reed to produce a multitude of tones and sounds. A user skilled in the art will be able to find many other sounding mechanisms to add variety while keeping to the principles of the rhythmic tracking of the unconstrained ball's motion as stated above.

What is claimed is:

1. A device for improving eye-hand and body coordination, comprising:

a hoop assembly having a pair of rings and a cooperating unconstrained ball;

each of said pair of rings being planar in form and identical to each other and having an inner periphery;

a plurality of posts connecting said rings in an axially spaced manner; and a plurality of clicking assemblies within said hoop assembly engageable by said ball as it is rolled about said ring inner peripheries, wherein each said clicking assembly includes a stationary post spanning said spaced rings, a pin slidably disposed through said stationary post, a clicking dowel affixed to the outer end of said pin and, elastic means yieldingly securing said dowel to said stationary post.

2. The apparatus of claim 1, wherein said connecting posts and said clicking assemblies are used to bridge said planar rings at points equidistant along the circumference of said planar rings.

3. The apparatus of claim 3, wherein said unconstrained ball is formed of fluorescent material, whereby said ball is viewable in the dark.

4. A device for improving eye-hand and body coordination, comprising:

a hoop assembly including a pair of rings and a cooperating unconstrained ball;

each of said rings being spaced apart, planar and identical to the other of said rings and having an inner periphery;

a plurality of posts connecting said rings in an axially spaced manner; and, a plurality of mechanically actuated clicking assemblies within said hoop assembly engageable by said ball as it is rolled about said ring inner peripheries.

5. The apparatus of claim 4, wherein each said clicking assembly includes, a stationary post spanning said spacing rings, a pin slidably disposed through said stationary post, a clicking dowel affixed to the outer end of said pin and, elastic means yieldingly securing said dowel to said stationary post.

6. The apparatus of claim 4, wherein said connecting post and said clicking assemblies are used to bridge said planar rings at points equidistant along the circumference of said planar rings.

7. The apparatus of claim 4, wherein said unconstrained ball is formed of fluorescent material, whereby said ball is viewable in the dark.

* * * * *